US005499878A

United States Patent [19]

Morgavi

[11] Patent Number: 5,499,878

[45] Date of Patent: Mar. 19, 1996

[54] DEVICE FOR MODIFYING THE TENSION OF A RIBBON WOUND ON A TAKE-UP REEL IN THE EVENT OF THE CLINGING OF THE RIBBON TO A PRINTING MEDIUM

[75] Inventor: Paul Morgavi, La Ciotat, France

[73] Assignee: Gemplus Card International, Gemenos, France

[21] Appl. No.: 420,508

[22] Filed: Apr. 12, 1995

[30] Foreign Application Priority Data

Apr. 15, 1994 [FR] France ..... 94 04830

[51] Int. Cl.[6] ..... B41J 33/36

[52] U.S. Cl. ..... 400/223; 400/249; 242/413.6; 226/195

[58] Field of Search ..... 400/223, 225, 400/232, 234, 235, 249, 248, 247, 208, 703, 712; 242/413.6, 413.5, 413.9, 412.2, 412, 410; 226/195, 45

[56] References Cited

U.S. PATENT DOCUMENTS

| | | | |
|---|---|---|---|
| 3,995,551 | 12/1976 | Mitter | 226/195 |
| 4,605,327 | 8/1986 | Ueki et al. | 400/234 |
| 4,775,086 | 10/1988 | Kataoka | 226/44 |
| 4,788,558 | 11/1988 | Caldwell et al. | 347/215 |
| 5,209,587 | 5/1993 | Herbert et al. | 400/225 |

FOREIGN PATENT DOCUMENTS

| | | |
|---|---|---|
| 0237979 | 10/1988 | Japan . |
| 63-274578 | 11/1988 | Japan . |
| 2202492 | 9/1988 | United Kingdom . |
| 88/01941 | 3/1988 | WIPO . |

OTHER PUBLICATIONS

Applegate, S. L., et al., "Electrothermal Ribbon Path", *IBM Technical Disclosure Bulletin,* vol. 23, No. 5, Oct. 1980, p. 2012.

*Primary Examiner*—Edgar S. Burr
*Assistant Examiner*—Anthony H. Nguyen
*Attorney, Agent, or Firm*—Pollock, Vande Sande & Priddy

[57] ABSTRACT

A device for improving a system for controlling the winding of a ribbon on a take-up reel. This device is particularly designed to obviate the phenomenon of clinging between a ribbon and the face of a card to be printed on, during an operation of printing by the thermal transfer of inks carried by the ribbon. For that purpose, the vertical shift of the ribbon is detected by a sensor associated with an optical detection device. The detection of this shift prompts the modification, in a circuit, of the number of steps per time unit of the step motor.

5 Claims, 1 Drawing Sheet

DEVICE FOR MODIFYING THE TENSION OF A RIBBON WOUND ON A TAKE-UP REEL IN THE EVENT OF THE CLINGING OF THE RIBBON TO A PRINTING MEDIUM

BACKGROUND OF THE DESCRIPTION

1. Field of the Invention

The present invention relates to a device for modifying the tension of a ribbon wound on a take-up spool or reel, the ribbon being designed, for example, for the thermal transfer, to a medium, of color inks arranged sequentially on the ribbon.

2. Description of the Prior Art

In a known technology of thermal transfer, the ink is not sprayed but deposited and fixed to the printing surface by means of the resistors forming a thermal printer head that heats up a ribbon coated with inks by using a modulated electrical current.

In another known technology, the primary color inks, yellow, magenta and cyan are deposited sequentially on a plastic ribbon making it possible, by the combination of different wavelengths called subtractive wavelengths, to obtain a range of several millions of colors or shades.

To obtain high-definition printing quality, especially in the graphic customizing of memory cards, it is very important to achieve perfect synchronization of the running speed of the ribbon beneath the thermal printer head with the horizontal speed of translation of the card to be printed on beneath the thermal printer.

The ribbon is wound on a feed reel, the shaft of which rotates freely. Another reel, called the take-up reel is used to wind the ribbon after use and is provided with a driving motor means. For a constant linear speed under the thermal printer head, the winding speed, expressed in turns of the take-up reel, varies at each turn since the diameter of the circumference of the winding drum increases with the thickness of a new layer.

The method of hot transfer of inks from the ribbon to the card implies a modulation of the temperature of the thermal head as a function of the shade: the dark colors require higher temperature than the light colors. For the printing of the dark colors, this technical feature tends to cause the clinging of the ribbon to the card owing to the softening of the plastic components of the card, the result of which is printing defects and the additional and unwanted driving of the card by the clinging ribbon, causing other printing defects.

The magnitude of this clinging phenomenon varies according to the composition of the material coating the two faces of the card to be printed. Indeed, in the case of plastic cards, the quantity of plastic components may vary from 5% to 20% depending on the manufacturer, which leads to a variation of the softening temperature from 50° C. to 70° C.

To overcome these drawbacks, use has been made of a flattener device, the function of which consists in modifying the escape angle or angle of release of the ribbon in order to create between the axes of the thermal printer head and the flattener, of a region of lower stress on the ribbon, a sort of belly that delays the pulling of the ribbon during the printing, enabling the spread of the ink in the material of the card, the delay being furthermore profitably used to cool the card and the ribbon.

A device to control the speed of the ribbon is described in the French patent application No. 94 02118 entitled "System and method for controlling the winding of a ribbon on a take-up reel", filed on 24th Feb. 1994 by the present applicant.

However, this prior art device proves to be insufficient when the phenomenon of the clinging of the ribbon becomes more important owing to the quality of the cards and the very dark shades of the inks.

One solution consists in permanently increasing the tension of the winding of the ribbon on the take-up reel but then this tends to cause a compressing of the turns of the ribbon already wound on the reel without its being possible to detect this variable by means of the device described.

SUMMARY OF THE INVENTION

The invention is therefore aimed at obtaining a device to modify the tension of the ribbon that overcomes this drawback.

To this end, the device according to the invention makes use of a sensor that permanently senses the ribbon after the flattener and, as a function of the identified position of the sensor, the device makes correction to the winding speed of the take-up reel.

The invention relates to a device for modifying the tension of a ribbon being wound on a take-up reel, said take-up reel being driven by a step motor that is controlled by a control system so as to obtain a linear speed of the ribbon that is constant irrespectively of the diameter of the ribbon drum on the take-up reel, said ribbon passing between a thermal printer head and a card to be printed on so that the inks carried by the ribbon are deposited on the card to be printed, wherein said device comprises:

a device to detect the position of the ribbon with respect to its normal running plane and a device to modify the number of steps, per time unit, of the step motor (16) when the ribbon moves away from its normal running plane.

BRIEF DESCRIPTION OF THE DRAWING

Other features and advantages of the present invention shall appear from the following description of a particular exemplary embodiment, said description being made with reference to the appended drawings, of which.

MORE DETAILED DESCRIPTION

Figure 1:
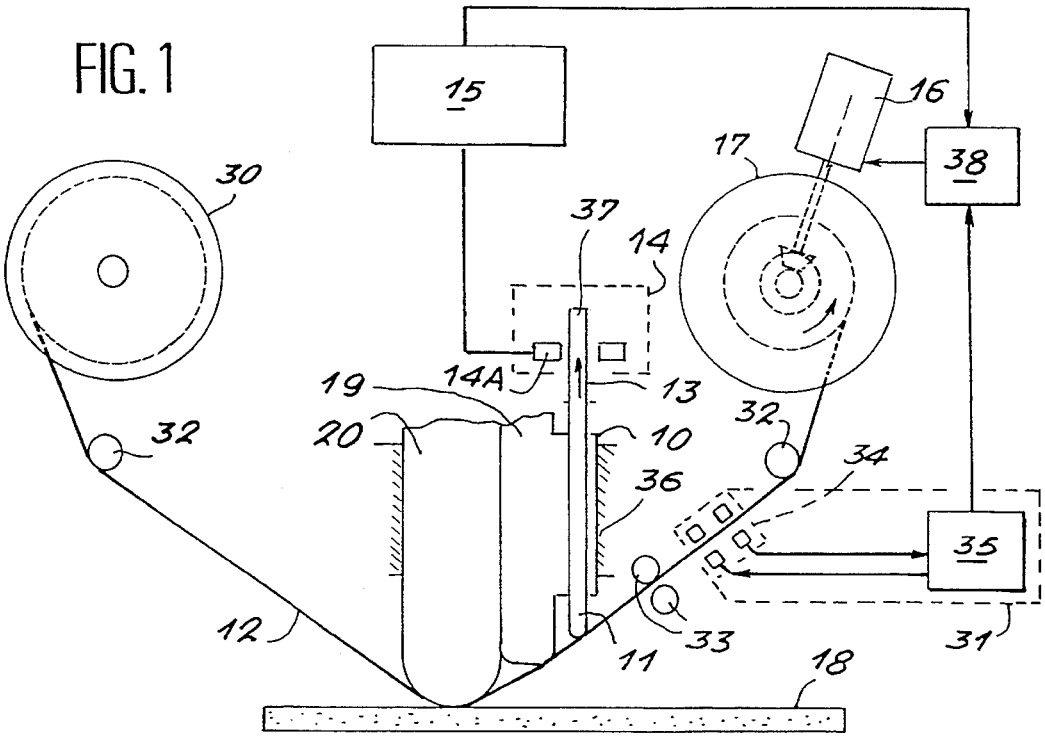
FIG. 1 shows a schematic view of a thermal printer head and ribbon comprising a device to modify the winding speed of the ribbon on the take-up reel according to the invention, the sensor of said device being in a normal position.

The printer to which the invention applies comprises a thermal printer head 20, the lower part of which has resistors heated by an electrical current that is modulated as a function of the shades to be obtained on a card 18 to be printed on. The inks used to obtain these colors are carried by a ribbon 12 that runs beneath the thermal printer head at the level of the resistors. The ribbon is stored in a feed reel and gets wound, after passing under the thermal printer head 20 guided by rollers 32, 33, on a take-up reel 17 that is rotationally driven by a motor 16. The motor 16 is of the step type and its rotation is actuated by an electronic system 31 so as to obtain a linear speed of the running of the ribbon 12 beneath the thermal printer head that remains constant irrespectively of the diameter of the ribbon drum on the take-up reel 17.

Such an electronic system 31 has been described in the French patent application No. 94 02118 filed on 24 Feb. 1994 by the present applicant and entitled: "System and method for controlling the winding of a ribbon on a take-up reel". The electronic system 31 comprises an optical detection device 34 to detect the shifting of the ribbon 12 and a microprocessor type electronic circuit 35 to compute the speed of the ribbon 12 and to determine therefrom, by computation, the number of steps, per time unit, of the motor 16.

With the printer head 20 there is associated a flattener device 19, the vertical position has been set during its assembly to modify the escape angle of the ribbon beneath the thermal printer head.

In the printer that has just been described, the device according to the invention has a sensor 10 that is fixedly joined to the thermal printer head 20 and the flattener 19 and is positioned after these two elements, in the direction in which the ribbon 12 runs.

This sensor 10 comprises a finger 13 that slides freely in a sheath 36 so that its lower end 11 remains in permanent contact with the face of the ribbon 12 which is on the printer head 20 side.

The upper end 37 of the finger 13 is associated with a detection device 14 in order to detect the vertical position of the finger 13 that comprises an optical cell 14A. During the vertical shifting of the finger 13, the upper end 37 conceals or reveals these cells separated by a determined distance. This enables an electronic circuit 15, receiving the signals from the cells, to compute the length of the vertical shifting of the finger 13. This information on the length of the shift is used in an electronic circuit or device 38 to modify the number of steps, per time unit, of the step motor 16 according to a determined function.

In another embodiment, this information element may be used directly by the microprocessor 35 which will then carry out the function of the device 38.

The device operates as follows. Should the printing of the card 18 take place normally (FIG. 1), the flattener 19 determines an angle of escape of the ribbon 12 detected by the finger 13 such that the cell 14A is masked and such that it is not necessary to make a correction to the tension of the ribbon 12.

Figure 2:
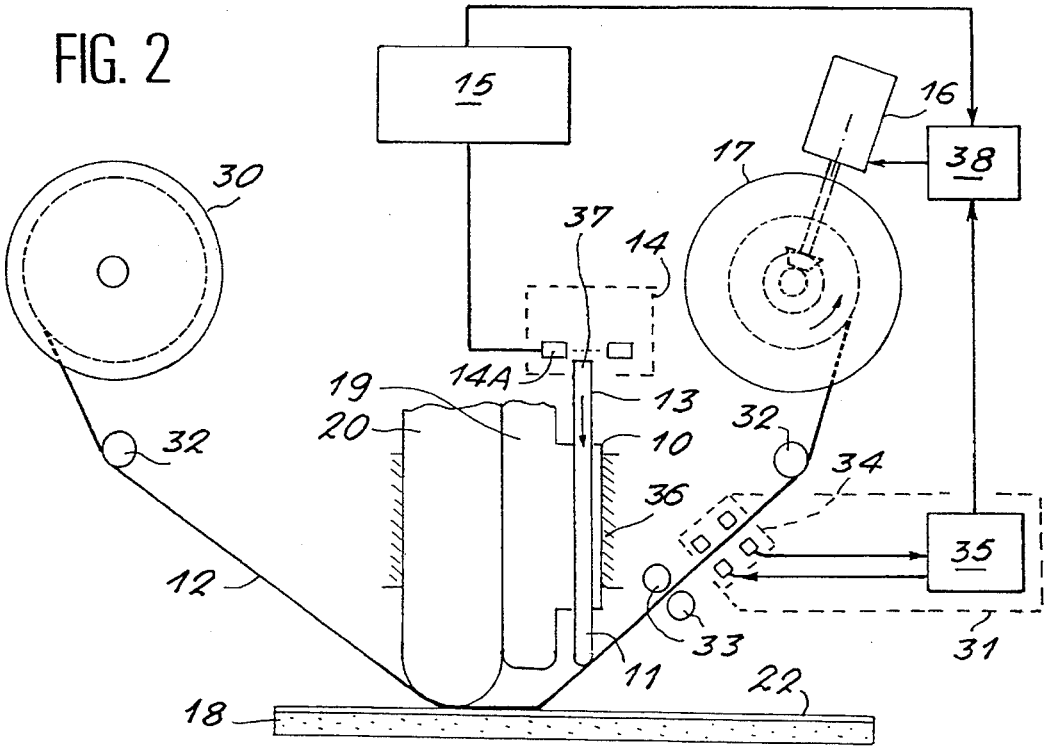
FIG. 2 shows a view similar to that of FIG. 1 showing the sensor of the ribbon in a position where it can detect a clinging phenomenon.

If, because of the composition of the plastic of its face 22 and the temperature of the thermal printer head 20, the printing of the card 18 should come up against a phenomenon of clinging or adhering between the ribbon 12 and the face 22 of the card 18 (FIG. 2), the flattener 19 is no longer in a position to play its role for it is no longer in contact with the ribbon. The finger 13 has followed the ribbon in the modification of its path so that the end 37 of the finger 13 reveals the detection cell 14A which sends an electrical signal to the electronic circuit 15.

Depending on the signals given by the detection cell 14A, the electronic circuit 15 computes the length of the shifting of the finger 13, this being a length that represents the length of the clinging of the ribbon 12 to the card 18.

This information on the length of the vertical shift of the finger 13 is transmitted to the modification device 38 (or to the microprocessor 35) of the system for the control of the step motor 16 of the take-up reel 17. The device 38 or the microprocessor 35 then modifies the number of steps per time unit by which the rotation of the step motor 16 must be increased in order to tension the ribbon 12 and bring it into contact with the flattener 19. This increase is gradual so as to not cause any jerky motions. Taking the normal speed as the reference, namely the speed used for the printing of a card in normal operation, the device 38 or the microprocessor 35 will gradually increase the number of steps per time unit according to a predetermined function and take it, for example, to +33% with respect to the value in normal operation.

As soon as the detection device 14 detects a modification of the path of the ribbon 12 which is transmitted to the finger 13, the device 38 or the microprocessor 35 carries out a corrective reduction in the number of steps per time unit of the step motor 16 in maintaining the gradual quality of the operation.

The device is therefore capable of permanently correcting the winding speed of the ribbon to compensate for the tension to be given to the ribbon to obviate the phenomenon of clinging, and of gradually returning to normal speed and tension.

What is claimed is:

1. A device for modifying the tension of a ribbon being wound on a take-up reel, a step motor, said take-up reel being driven rotationally by said step motor, a control system for controlling said step motor to obtain a linear speed of the ribbon that is constant irrespectively of the diameter of the ribbon on the take-up reel, said ribbon passing between the thermal printer head and a card to be printed on, so that the inks carried by the ribbon are deposited on the card to be printed on, wherein said device comprises:

means for detecting the position of the ribbon with respect to its normal running plane and means for modifying the number of steps, per time unit, of the step motor when the ribbon moves away from its normal running plane.

2. A device according to claim 1, wherein the means for detecting the position of the ribbon comprises:

a sensor comprising a finger sliding freely in a sheath fixedly joined to the thermal printer head, one end of said finger being in permanent contact with a face of the ribbon, an indicator device to indicate the shifting of the finger, and an electronic circuit for measuring the shifting of the finger of the sensor, said electronic circuit providing a signal that is applied to the device for modifying the number of steps per time unit.

3. A device according to claim 1 or 2, wherein the means for modifying the number of steps of the motor is an integral part of the system for the control of the step motor.

4. A device according to claim 1 or 2, wherein the modification of the number of steps per time unit is done gradually in relation to a reference number of steps.

5. A device according to claim 1 or 2, wherein the device for detecting the position of the ribbon is placed after the thermal printer head in the direction of the running of the ribbon.

* * * * *